US010406053B2

(12) United States Patent
Stanislao et al.

(10) Patent No.: US 10,406,053 B2
(45) Date of Patent: Sep. 10, 2019

(54) ROTATING AND ARTICULATING SLEEPING ASSEMBLY

(71) Applicants: Joseph Stanislao, Bozeman, MT (US); David Yakos, Bozeman, MT (US); Stephen Sanford, Bozeman, MT (US); Ross Walker, Belgrade, MT (US)

(72) Inventors: Joseph Stanislao, Bozeman, MT (US); David Yakos, Bozeman, MT (US); Stephen Sanford, Bozeman, MT (US); Ross Walker, Belgrade, MT (US)

( * ) Notice: Subject to any disclaimer, the term of this patent is extended or adjusted under 35 U.S.C. 154(b) by 228 days.

(21) Appl. No.: 15/650,882

(22) Filed: Jul. 15, 2017

(65) Prior Publication Data

US 2018/0014990 A1 Jan. 18, 2018

Related U.S. Application Data

(60) Provisional application No. 62/362,887, filed on Jul. 15, 2016.

(51) Int. Cl.

| | |
|---|---|
| ***A61G 7/16*** | (2006.01) |
| ***A61G 7/015*** | (2006.01) |
| ***A61G 7/005*** | (2006.01) |
| ***A61G 7/10*** | (2006.01) |
| *A61G 5/00* | (2006.01) |

(52) U.S. Cl.

CPC ..... *A61G 7/16* (2013.01); *A61G 7/005* (2013.01); *A61G 7/015* (2013.01); *A61G 7/1076* (2013.01); *A61G 5/006* (2013.01)

(58) Field of Classification Search

CPC ..... A61G 7/005; A61G 7/015; A61G 7/16; A61G 7/1076; A61G 5/006

See application file for complete search history.

(56) References Cited

U.S. PATENT DOCUMENTS

| | | | | |
|---|---|---|---|---|
| 5,095,561 A * | 3/1992 | Green | ..... | A61G 7/012 297/DIG. 10 |
| 5,497,518 A * | 3/1996 | Iura | ..... | A61G 7/002 5/616 |
| 6,880,186 B2 * | 4/2005 | Johansson | ..... | A61G 7/015 5/81.1 R |

(Continued)

FOREIGN PATENT DOCUMENTS

| | | | | |
|---|---|---|---|---|
| DE | 202013001182 U1 * | 2/2013 | ..... | A61G 7/053 |
| FR | 2887438 A1 * | 12/2006 | ..... | A61G 7/00 |

(Continued)

*Primary Examiner* — Christopher R Harmon

(74) *Attorney, Agent, or Firm* — Charles McCloskey

(57) ABSTRACT

An assembly has a frame with two ends and two rails with a drop section generally centered, a base plate spanning the rails at the drop sections, a turn table upon the base plate, a pivot tray upon the turn table, linkages upon the pivot tray, sections operatively connected to the linkages, spring panels upon the sections, and a mattress upon the section. Senior citizens, patients, and disabled persons find difficulty to enter and to climb out of bed and may frequently require assistance. When this problem occurs, others must assist a person and the assistance varies depending on the person's size, weight and degree of mobility. The present invention adapts easily to most standard bed frames and allows a patient to rotate clockwise or counterclockwise and then to a sitting position.

7 Claims, 6 Drawing Sheets

(56) References Cited

U.S. PATENT DOCUMENTS

| | | | | |
|---|---|---|---|---|
| 8,375,489 | B2 * | 2/2013 | Manouchehri | A61G 7/0513 5/600 |
| 9,265,677 | B2 * | 2/2016 | Manouchehri | A61G 7/0507 |

FOREIGN PATENT DOCUMENTS

| | | | | |
|---|---|---|---|---|
| WO | WO-2010030896 | A2 * | 3/2010 | A61G 7/053 |
| WO | WO-2011087616 | A2 * | 7/2011 | A61G 7/0507 |

* cited by examiner

ROTATING AND ARTICULATING SLEEPING ASSEMBLY

CROSS-REFERENCE TO RELATED APPLICATION

This non-provisional application claims priority to pending provisional application No. 62/362,887 filed on Jul. 15, 2016 all of which are owned by the same inventor.

BACKGROUND OF THE INVENTION

The rotating and articulating sleeping assembly generally relates to medical equipment and more specifically to an adjustable bed.

The present invention typically sees use in a hospital or nursing care facility and often has the name in the medical and nursing care industries as a low height adjustable bed or a low bed. People do many things in bed from sleeping to reading and other activities in between. Sleeping consumes most of the hours spent in a bed during the lifetime of a person. A bed provides a comfortable and flat surface upon which a person may recline into a flat or supine position. Usually, a person goes to sleep from there. A supine position also provides a suitable position for a person, called a patient, for recovery and recuperation from the activities of medical procedures. A supine position then also provides positioning for a person, called a resident, to receive the activities from nursing care. In time, a person, a patient, or a resident, may desire to exit from a bed. An able bodied person exits a bed under his own power, as sense from the saying "like falling out of bed." A patient or a resident may require assistance to enter into a bed and to exit from a bed. Staff of the hospital or nursing care facility then assist from light effort to heavy work in moving the patient or resident. The staff then endures the rigors of moving a patient or a resident while the patient or resident may have lessened esteem by requesting such assistance.

DESCRIPTION OF THE PRIOR ART

For millennia, people have slept where they could. People would sleep on the ground, in hay lofts, in barns, in hammocks, and the like. People developed many creative ways to catch forty winks. In the last four centuries, people developed beds, from the wealthy at first, and then widely dispersed to all peoples. People have recognized that a mattress upon a frame provides for superior rest and sawing of many logs. Present day beds come in select sizes of mattresses and in an abundance of frames and other supports for beds.

As mentioned above, beds also see use in medical and nursing facilities for the rest and recuperation of their patients and residents respectively. Hereinafter, the patients from a medical facility and the residents from a nursing facility shall be described as patients. Prior art low bed height and angle adjustable bed designs provide independent front and rear lifting and support capabilities and further provide a bed rolling capability when maintained at a specific factory set height, such as a fully lowered position. The conventional low bed design provides a wide range of bed height positioning including positioning very close to the floor. A typical low bed design further provides one or more pair of end lift support arms pivotally attached near the bed central axis which extend toward the head or foot of the bed. The end lift support arms help to provide the aforesaid desirable low bed features and typically contain rollers, but not castors, near the ends opposite the pivotal attachment points. The support arms typically have control from a mechanical or hydraulic actuator which causes the support arms to pivot around each attachment point. Prior art low bed design requires the support arms to have a position at a specific angle relative to the bed before the bed may be rolled on the floor. In summary, prior art low beds do not allow roll at any user selected height or angle position.

The difficulty, in providing two dimensional bed movement of a bed while also maintaining bed stability, is exemplified by the operation of a typical offset castor wheel. The center axis of a castor wheel, as used on a desk chair, or hospital bed, has an offset from its mounting stud to ensure proper tracking when pushing the chair or bed. That is, if the center axis has no offset, the castor will not have the necessary moment arm around its mounting stud axis to ensure positioning and tracking of the castor in the movement axis of applied force. A castor mounting stud must maintain a nearly perpendicular relationship with the X-Y floor axis of movement in order to operate properly and avoid premature failure. If a typical castor mounts directly onto a low bed end lift support arm, when the arm moves about its axis, the castor stud will obtain a position which is not perpendicular with the X-Y floor axis. This non-perpendicular positioning will prohibit the castor from functioning as expected. Thus, prior art low beds do not provide for two dimensional rolling movement of the bed unless the bed attains its factory determined position: usually a fully lowered position.

Besides support arms and castors, prior art beds provide for elevation of a patient. The elevation may lift the head, the feet, or both of a patient. Typically, prior art beds have a frame with its rails provided in sections. The sections generally pivot near the middle of the bed and thus raise the head or the feet of a patient. Select beds retain their mattresses as unbent but rather raise or lower the head or the foot of the bed to adjust the positioning of a patient. During these positions of a prior art bed, the length of the mattress generally remains parallel to the length of the bed. A patient still requires assistance of staff to enter and to exit a bed.

The present invention overcomes the disadvantages of the prior art and provides an unique ability to fold the bed and elevate a patient upon it, then rotate the bed, and then rotate the bed about a second axis. The two rotations orient and move a patient from a recumbent position to a sitting position from which a patient may walk from the side of the assembly and away from the bed. That is, the art of the present invention allows the user to turn and elevate a patient for ready exiting away from the bed. The present invention assembly allows a person to lock the bed and prevent rotation of the assembly once it has rotated ninety degrees from its usual orientation.

SUMMARY OF THE INVENTION

Most senior citizens or disabled individuals eventually find themselves requiring assistance getting into and out of bed. The need for assistance getting in and out of bed occurs in nursing homes, hospitals, private homes, and other medical facilities. In nursing homes, the rotating and articulating sleeping assembly can serve the needs of aging and ill residents, assisting them and their caretakers with the task of entering and exiting the bed. A need for the rotating and articulating sleeping assembly comes from hospitals where patients recovering from surgery or illness must get in and out of bed for physical therapy, exercise or to use the restroom. In a home, where a family member may experience back problems or illness, assistance getting in and out of bed becomes extremely useful. For people with any kind of disability, getting in and out of bed becomes a painful and difficult process. By assisting a person into a sitting position, and then rotating the person ninety degrees (90°), exiting the bed becomes less stressful on both the person and care-taker. The rotating and articulating sleeping assembly addresses those problems. The rotating and articulating sleeping assembly has its development and design for people of all ages who suffer from back problems, recover from surgery, or lack the strength to easily get in and out of bed.

The invention has two parallel drop sections and two parallel cross members that define a frame. The frame then connects to a headboard and a footboard. A turntable rests upon a base plate where the base plate spans across the drop sections. A pivot tray connects to the turntable and a bed frame operatively connects to the turntable. The bed frame has three sections that correspond with the calves, thighs, and torso of a patient. The sections then include mechanisms for their folding. Upon the sections, the assembly includes a planar set of springs and a mattress upon that. The sections operate upon electrical actuators subject to a common controller. The invention also has a crank mechanism operatively connected to the turntable for operation of the invention without electrical power.

There has thus been outlined, rather broadly, the more important features of the invention in order that the detailed description thereof that follows may be better understood and that the present contribution to the art may be better appreciated. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a rotating and articulating sleeping assembly that rotates a patient from supine and lengthwise upon a bed to sitting and transverse upon a bed.

Another object is to provide such a rotating and articulating sleeping assembly that allows the user to enter or exit bed with relative ease and minimal effort.

Another object is to provide such a rotating and articulating sleeping assembly that converts the user into a sitting position from a supine position either manually or automatically.

Another object is to provide such a rotating and articulating sleeping assembly that allows the bed occupant to be rotated 90° clockwise or counterclockwise while in a sitting position.

Another object is to provide such a rotating and articulating sleeping assembly that enables the user to enter or exit a bed from a sitting position on either side of the bed with minimal assistance.

Another object is to provide such a rotating and articulating sleeping assembly that allows the occupant using a portable table to eat or perform other tasks from a comfortable sitting position on either side of the bed.

Another object is to provide such a rotating and articulating sleeping assembly that is capable of manufacturer and distribution at a price suitable for the end customers, supply houses, retailers, and catalogs to provide.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
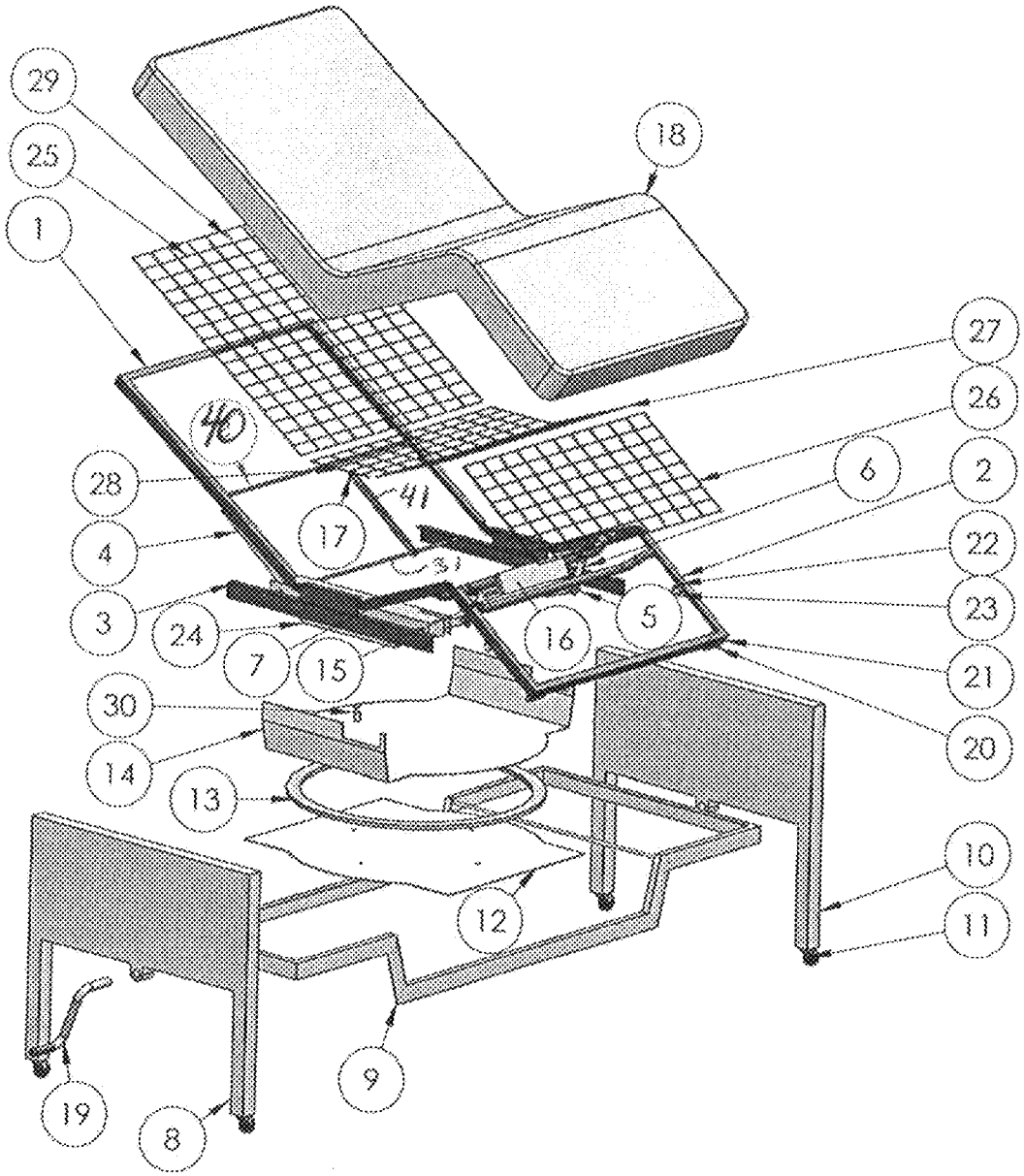
FIG. 1 shows an exploded perspective view of the invention.

The present invention overcomes the prior art limitations by providing a rotating and articulating sleeping assembly used by people, patients in medical facilities, residents in nursing homes, and the like, hereinafter called patients. FIG. 1 shows the invention in an exploded perspective view and without a patient occupying it. The invention begins with a headboard 8 and mutually parallel and spaced apart footboard 10. The headboard and the footboard each have two mutually parallel and spaced apart legs. Each leg terminates in a foot and has a caster wheel 11 upon each foot. Spanning between the headboard and the footboard, the invention has a drop section 9 with two mutually parallel and spaced apart ends also parallel to the headboard and the footboard. The drop section has two spaced apart rails joined to the ends and the rails generally define the length of the invention. The rails have a generally perpendicular orientation to the headboard and the footboard. Each rail has a centered portion offset below the plane defined by the two ends. The headboard also has a bearing that receives a crank handle 19 and its related mechanism for operating the invention without electric power as later described. The crank handle also functions to narrow the distance from the foot of the bed to the floor when the bed attains the exit position, as later shown and described.

The centered portions of the two rails receive a rotational platform that turns the bed as the key feature of the invention. The rotational platform begins with a base plate 12 that spans between the two centered portions. The base plate has a generally planar form and a thickness to prevent its deflection when under load of a three hundred pound patient. The base plate also has four holes spaced 90° apart around a circle. A turn table 13, here shown as a ring or raceway, connects to the base plate. The turn table has a generally round form and a centered location upon the base plate and within the centered portions of the rails. The turn table is also concentric with the four holes of the base plate. The turn table receives a pivot tray 14. The pivot tray has its central portion being planar and then two folded upwardly spaced apart wings. A rotational lock pin 30 in the pivot tray 14 lowers and engages with one of the four holes in the base plate 12, thus locking the invention at 90° positions. When the rotational lock pin 30 is raised, the bed freely rotates about 360°. The pivot tray 14 mounts as a sub-assembly with the remainder of the invention.

The pivot tray then bolts to a seat-frame section upon at least four locations. The seat frame section includes mounts for an electric drive motor 24, a pivoting linkage for the patient's thigh as at 5, a pivoting linkage for the patient's back as at 4, and it has a pivotal attachment to a back section 1 and thigh section 7. The electric drive motor has a solid mount to a seat section of a frame 3, and when activated, rotates the pivoting linkages for both the thigh as at 5 and the back as at 4 independently. Further, the pivoting link for the thigh section as at 5 connects via a linkage on both sides for symmetric application of loads during movement and rotation of the bed as later described.

The back section 1 functions the same as the thigh section 7, connecting to two linkages on both sides, which then connect to a rotational linkage as at 6 driven by the electric drive motor 24. The rotation linkage bar 6 is a round bar with its own two ends and two trailing arms, as at 4, 5, one on each end and has a third trailing arm, as at 6*a,* driven by the electric drive motor 24. Two linkages have a pivotally attach to an end of the rotational linkage bar 6 which in turn pivotally attach to the back section 1. When the rotational link 6 rotates upwardly, it transfers the force through the linkages to the back section 1 forcing that portion of the bed of the invention to rise as the trailing arms rotate upwardly. This same rotational link 6 cooperates with the back section 1 and the thigh section, but the linkages are different lengths. The various linkages connect at their ends using pivot pins 17, typically two pins per linkage. The linkages also include a bed link 31 spanning across the back section 1 generally proximate its pivoting axis with the frame 3 and a midback link 40 also spanning across the back section proximate the midpoint of the back section. A spine link 41 spans from the bed link 31 to the midback link 40 generally along the center of the back section.

Outwardly from the thigh section 7, the invention has a leg frame section as at 2 that pivotally attaches to the thigh section 7 and freely pivots. Within the bed frame 3, a bump stop 15 between the thigh section and the leg section limits a relative angle between the thigh section and the leg section to approximately 96° interior angle. The bump stop has a second bump stop as at 16 coaxial with the bump stop 15 but at an alternate angle of rotation. The thigh section 7 rises up during usage so the end of the bed rises higher than the two ends of the drop section 9 because of engagement with the bump stop 15. On the outward ends of the leg sections 2 are slide blocks 20 which allow an end of the foot section to smoothly slide atop the drop section, particularly outwardly of the centered portion. When the bed has an orientation parallel to the floor of a facility, or supporting surface, the slide blocks 20 on the end of the foot section 2 engage with the bed rails as at 9, guiding the foot section 2 downwardly to a horizontal orientation. When the foot section 2 reaches its top most position, it clears the bed frame as at 9 by approximately one inch thus permitting the bed to rotate 360°.

The slide blocks 20 do not engage the drop section 9 when rotated 90° to the drop section, instead they keep the foot section 2 against the bump stop 15 while the thigh section 7 lowers. The thigh section 7 functions the same by lowering to a horizontal orientation, but rather than the foot section 2 sliding to the same horizontal plane as the thigh section 7, it lowers 96° relative to the thigh section, allowing the patient's feet to meet the floor.

The thigh section, the leg section, and the back section have generally hollow rectangular forms made of connected members. In the preferred embodiment, adjacent members connect at their joints using bolts 21 and hex nuts 22. Further, the linkages previously described also have their pivotal connections to the sections using bolts 21 and hex nuts 22. Upon the linkages, the connection may also utilize washers and other fittings that permit rotating but limit disengagement of the bolts from the hex nuts.

The foot section has its slide blocks 20 as described above. The foot section has its connected members as shown and described. The foot section has two members that extend generally in the direction of a patient's leg. Upon each member, a short slide block 23 joins proximate the midpoint of each member. The short slide blocks allow these two members to glide upon the drop section 9 when the invention has rotated ninety degrees.

Having described the framing and heavy components of the invention, this assembly also has above the linkage a plurality of spring panels. The spring panels connect to the foot section, thigh section, and back section. The invention has a back spring panel 25 that spans the back section 1, generally between its members both across the back section and upon its length for support of a patient's torso; a seat spring panel 28 that spans the seat section as at 3 both across the section and for its short length for support of a patient's hips; a thigh spring panel 27 that spans the thigh section 7 both across that section and upon its length for support of a patient's legs; and, a foot spring panel 26 that also spans across the foot section 2 and its short length for support of a patient's calves and feet. The invention's four spring panels include a plurality of springs 29 arrayed in a grid like pattern. The springs span across each panel and extend for its length. Where each spring has a rectilinear intersection with another spring, that is, the points on the grid, each spring panel has a loose tie of the two springs. The loose tie permits slight relative motion of one spring to another during motion of a patient upon the invention.

Upon the four spring panels and their corresponding sections beneath, the invention has a mattress 18. The mattress has a generally rectangular shape with a width much less than its length and a thickness. The mattress is similar in size to a twin size mattress. This mattress 18 though has its thickness, stuffing, and surface construction so that the mattress 18 may deflect at two locations. The mattress deflects where the back section 1 pivots upon the frame 3 and the foot section 2 pivots upon the thigh section 7. The mattress construction permits numerous cycles of deflection over its design lifespan.

Figure 2:
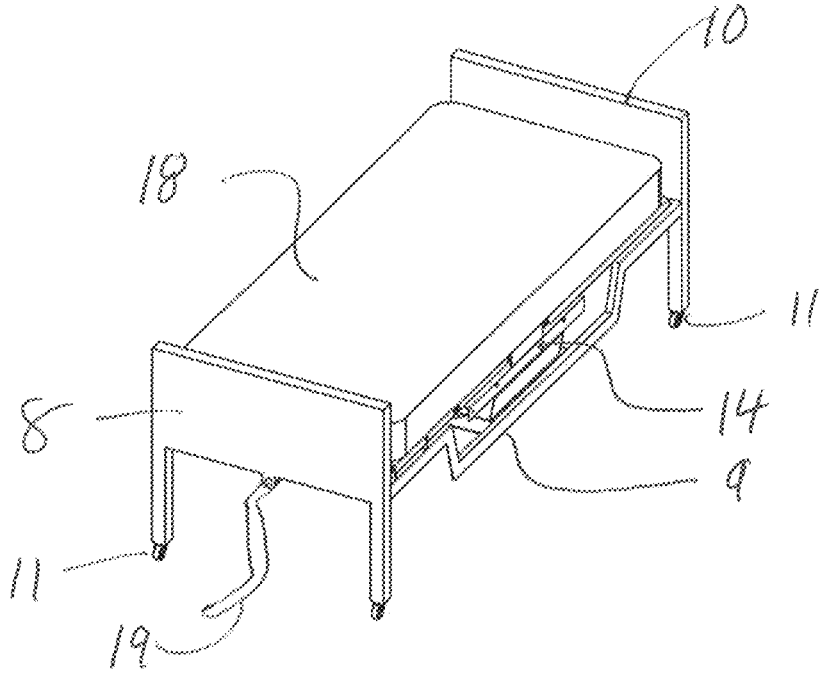
FIG. 2 has a perspective view of the invention in a supine position.
Figure 3:
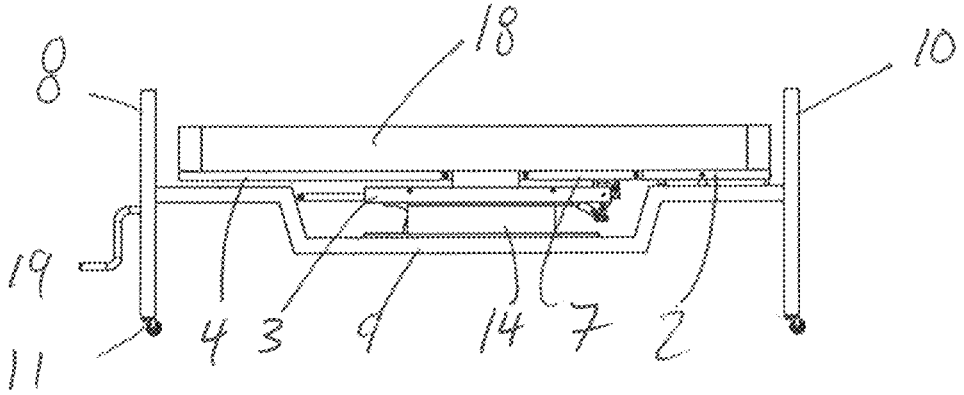
FIG. 3 has a side view of the invention in the supine position.

Having described the components of the invention, the invention has four operating positions: lay, sitting, rotation, and stand. FIG. 2 shows the lay position in a perspective view of the rotating and articulating sleeping assembly. The assembly has its headboard 8 and footboard 10 connected by the drop section 9. The pivot tray 14 has the above mechanisms upon it. The mattress rests upon the various spring panels and sections. In the lay position, the mattress 18 has a flat orientation and fits within the headboard and the footboard. A patient typically lies supine upon the mattress when in this position. The lay position, also known as first position, starts in the horizontal position and functions similar to a medical bed, allowing the patient to raise their back and/or legs with electric controls, but the invention includes the additional function of assisting the user into a standing position as later describe. The bed has a standard medical bed size and can be adjusted for height via the crank handle 19. FIG. 3 shows the invention in the first position from a side view with the mattress upon the supporting mechanism and the mechanism recessed with the drop section 9.

Figure 4:
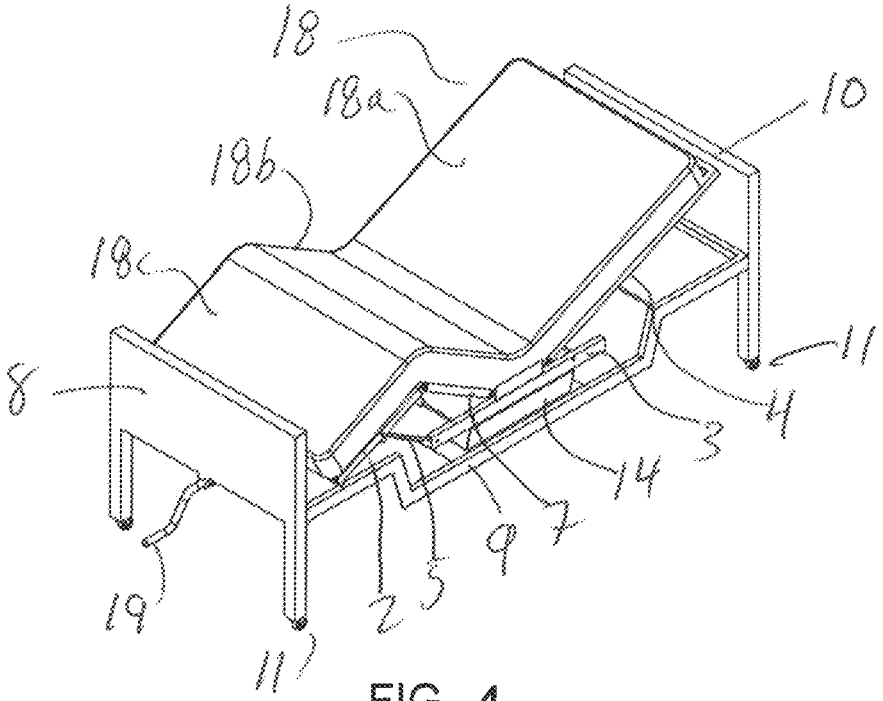
FIG. 4 describes a perspective view of the invention in a sitting position.
Figure 5:
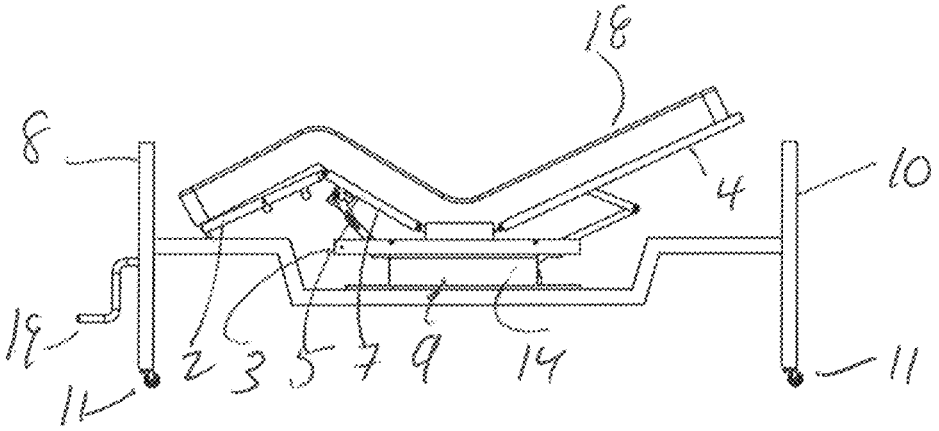
FIG. 5 describes a side view of the invention in the sitting position.

FIG. 4 shows the sitting position in a perspective view of the rotating and articulating sleeping assembly. As before, the mattress 18 remains within the footboard 10 and the headboard 8 upon the drop section 9. The mattress has three portions divided by two folding positions: a back portion 18*a* generally beneath a patient's back, a thigh portion 18*b* inwardly from the back portion and generally beneath a patient's hips and thighs, and a foot portion 18*c* outwardly from the thigh portion 18*b* and generally beneath a patient's calves and feet. The three portions of the mattress take form when the Rotating and articulating sleeping assembly moves the patient into a sitting position with his legs bent up at the thigh and down at the knee prior to rotation via the electric drive 24. When raising the leg section to the upper position, the foot section of the bed slides along the frame rails on the slide blocks, 20, 23, and before reaching an upper limit, the leg section engages with the bump stop, 16, forcing the slide blocks to rise above the bed frame as at 9, and providing clearance during rotation. The back portion of the bed also rises upon the linkages to clear the headboard during rotation. FIG. 5 shows the invention in the second position from a side view with the mattress upon the supporting mechanism, the supporting mechanism folding the mattress while elevating the back and the thigh portion, and the mechanism recessed with the drop section 9.

Figure 6:
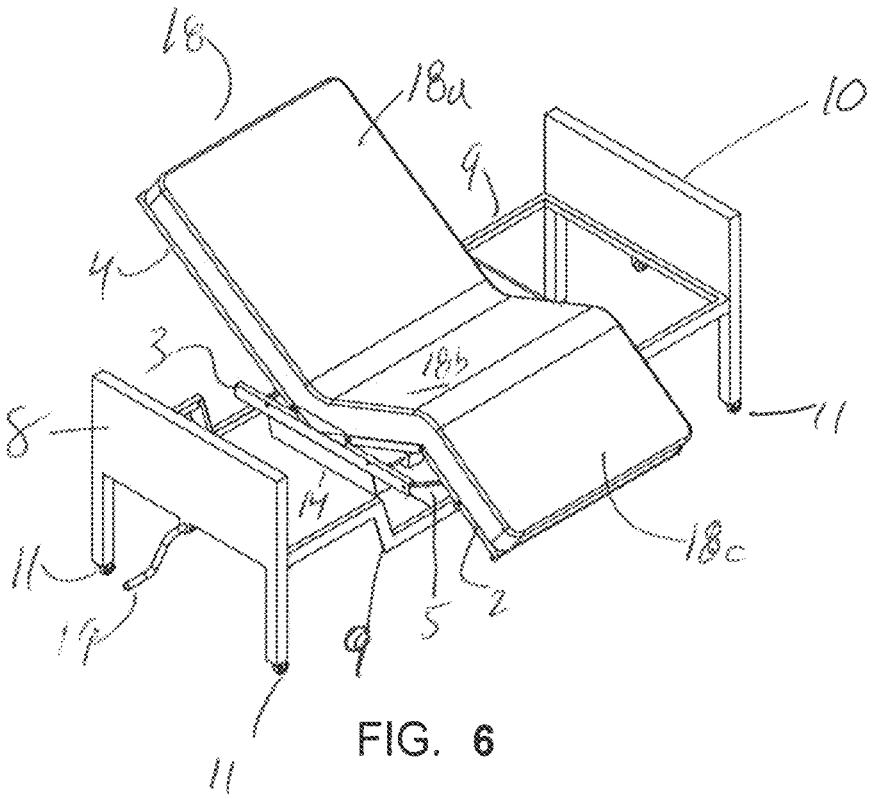
FIG. 6 shows a perspective view of the invention in a rotated position.
Figure 7:
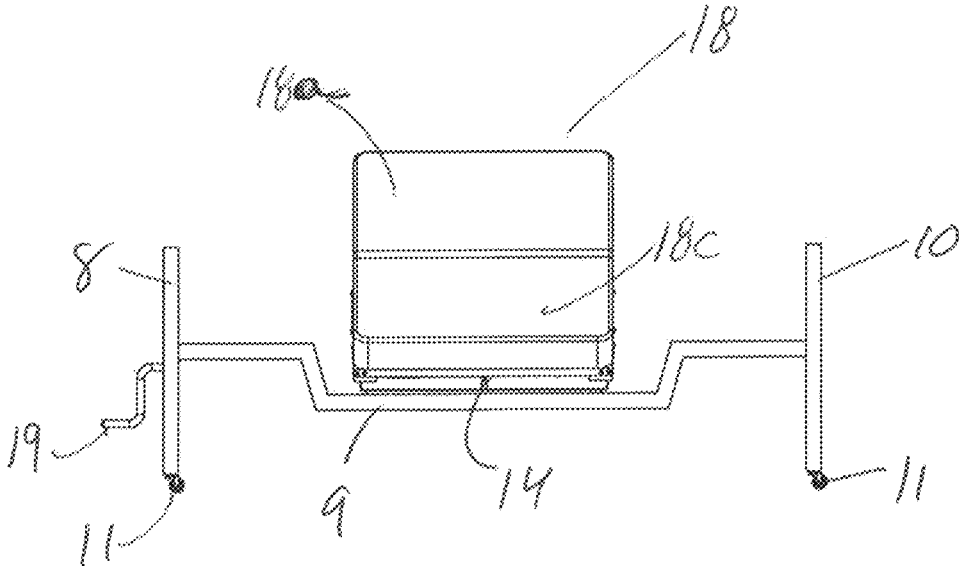
FIG. 7 describes a side view of the invention in the rotated position.

FIG. 6 shows the rotation position in a perspective view of the rotating and articulating sleeping assembly. As before, the mattress 18 remains within the footboard 10 and the headboard 8 upon the drop section 9. During usage, a user, such as medical staff, seeks to rotate a patient to exit, or to enter, a bed. By releasing the rotational lock pin 30 the bed, may freely rotate through 360°. The bed's center of gravity makes it possible to rotate the bed with very little effort—even with a patient upon it. The rotating and articulating sleeping assembly has a symmetrical construction as previously described, so it can easily rotate for either a left side or a right side exit by a patient. The bed's rotation also allows it to operate with the patient's head at the either the head or foot of the bed. This 360° rotation provides full access to the occupant to exit on either side solo, or with assistance by an aide. Rotation occurs as a manual operation by medical staff who operate the lock pin 30 and turn the frame sections upon the turn table 13 upon the pivot tray 14. In an alternate embodiment, the invention includes an electric drive configured to turn the turn table. FIG. 7 shows the invention in the third position from a side view with the mattress upon the supporting mechanism, the supporting mechanism folding the mattress while elevating the back and the thigh portion, the supporting mechanism rotated ninety degrees, here with the foot section shown in the foreground, and the mechanism recessed with the drop section 9.

Figure 8:
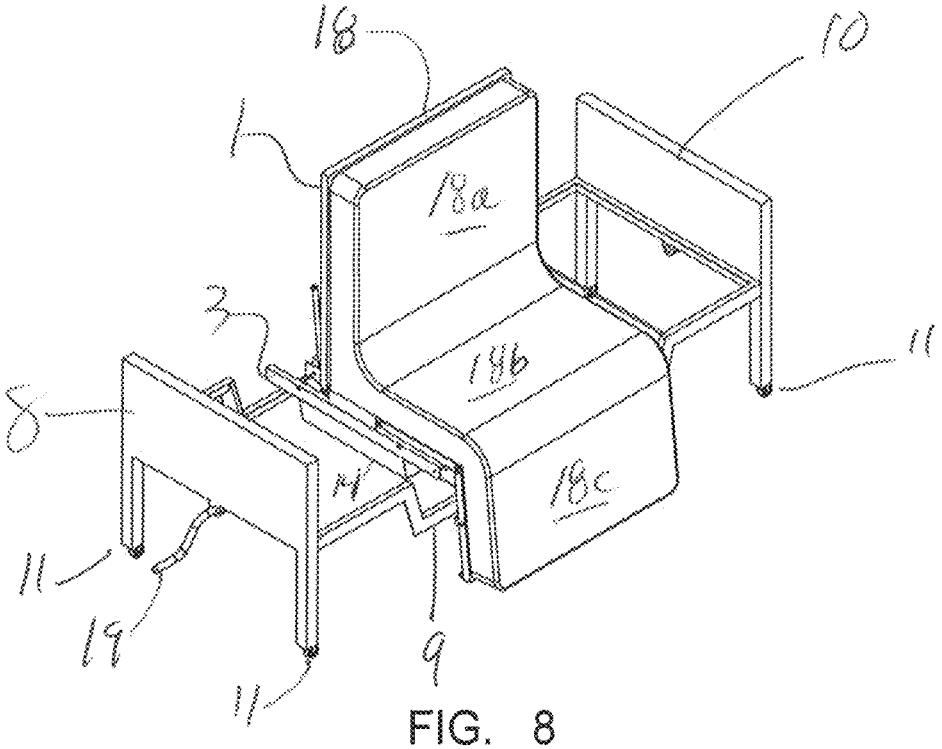
FIG. 8 shows a perspective view of the invention in a standing position.
Figure 9:
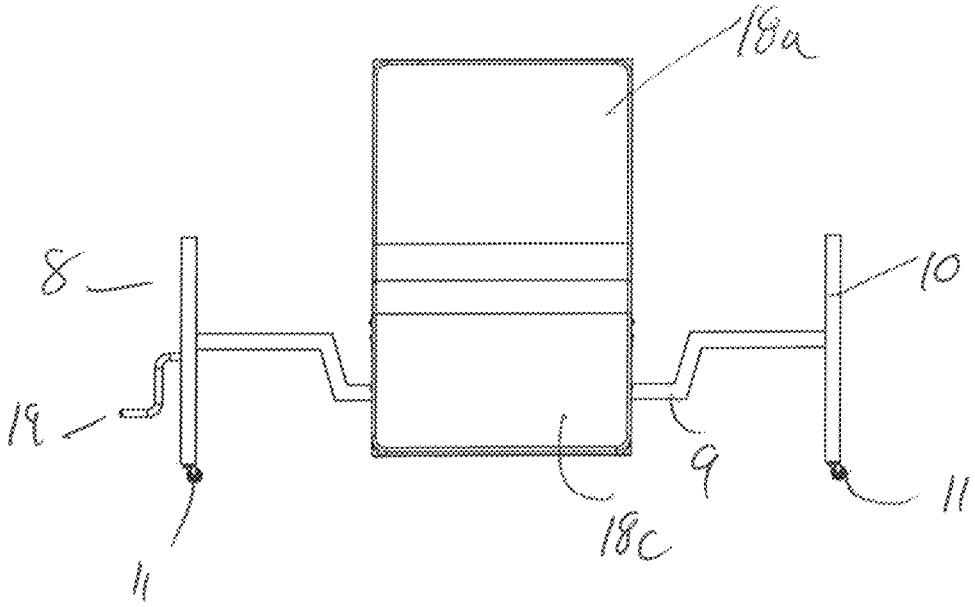
FIG. 9 describes a side view of the invention in the standing position.

FIG. 8 then has the stand position in a perspective view of the rotating and articulating sleeping assembly. Transitioning from FIGS. 6, 7, the invention has the mattress 18 oriented perpendicular to the length of the bed, the back portion upright, and the foot portion down. The back portion extends upwardly from the plane of the lay position and the foot portion drops downwardly from the plane of the lay position, or opposite the back portion. Once rotated to the left or right side of the frame 9, a user engages the rotational lock 30 (not shown) to retain the bed at 90° from the headboard and the user can begin to lower the leg section. Because the foot slide blocks do not interact with the frame at this angle of rotation, the leg section remains against the bump stop allowing the patient's feet to reach the ground, the patient to stand and then exit the bed. FIG. 9 shows the invention in the fourth position from a side view with the mattress upon the supporting mechanism, the supporting mechanism folding the mattress while propping upright the back portion and dropping the thigh portion, the supporting mechanism rotated ninety degrees, here with the foot section and foot portion 18*c* visibly shown in the foreground, and the mechanism recessed with the drop section 9.

Figure 10:
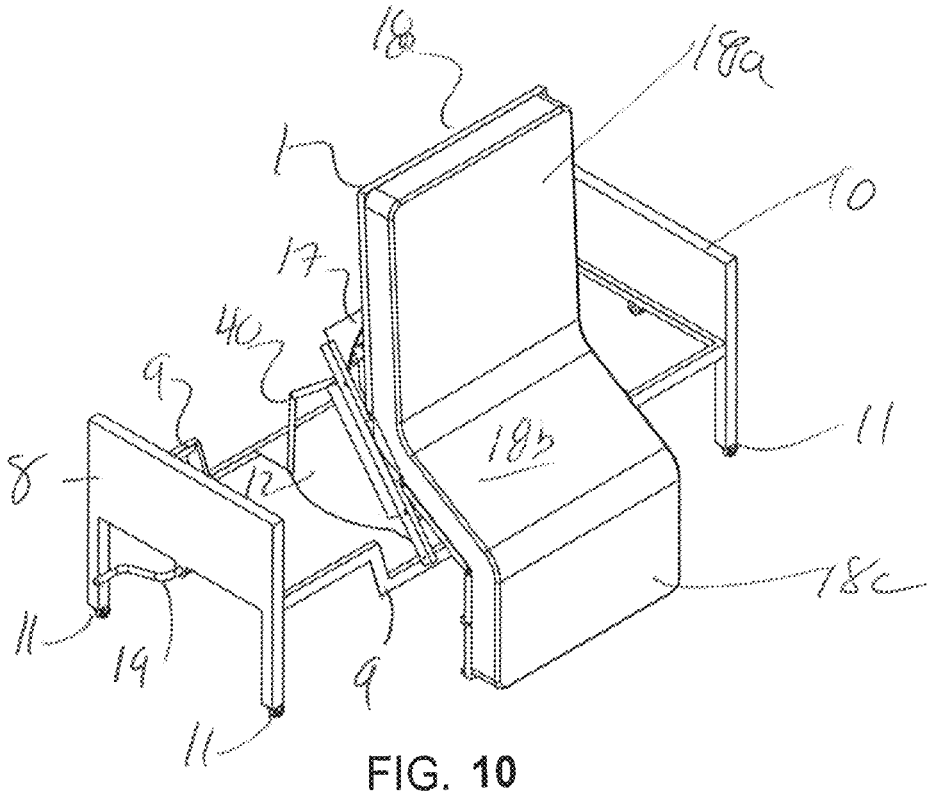
FIG. 10 illustrates a perspective view of the invention in a boost position; and, FIG. 11 illustrates a side view of the invention in the boost position.

FIG. 10 then shows a perspective view of an alternate embodiment where the rotating and articulating sleeping assembly has additional linkage 43 that further assists the patient by adding a tilt from the pivot tray to the turn table. This modification allows the patient to use the bed as described above with the additional action of tilting the seat portion 18*b*, transitioning the patient from a sitting position to a standing position. This alternate embodiment provides a boost out of bed for the patient.

Figure 11:
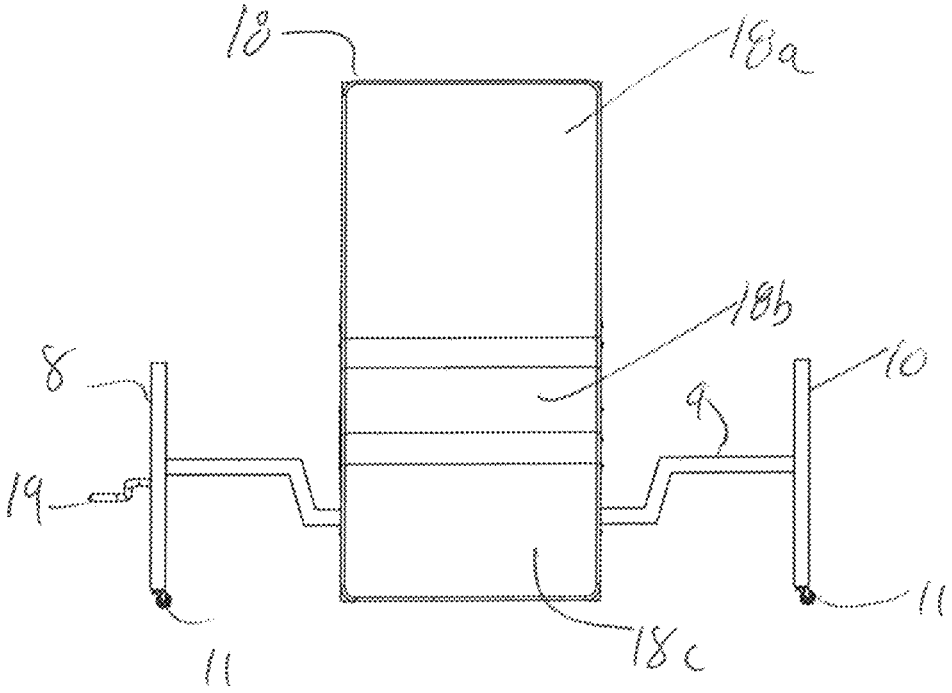

FIG. 11 shows the invention in an alternate embodiment of the fourth position from a side view with the mattress upon the supporting mechanism, the supporting mechanism folding the mattress while propping upright the back portion and dropping the thigh portion, the supporting mechanism rotated ninety degrees, here with the foot section and seat portion 18*b* and the foot portion 18*c* visibly shown in the foreground, and the mechanism recessed with the drop section 9.

The present invention in both its preferred embodiment and alternate embodiments may operate upon motors as at 24 or upon manual hand cranking as at 19. Moreover, the present invention rotates through three hundred sixty degrees and the various linkages and mechanisms, the at least two sections, the at least two spring panels, and the mattress cooperate for transverse unloading and loading of patient off and on the invention. The present invention generally has its pivoting and rotating proximate, or near, the center of mass of a patient. The present invention also then gently bends the legs of a patient so the patient's knees near ninety degrees of bend and then rotates the patient so the patient's feet have an orientation towards a supporting surface, that is, the feet are just about at the floor near the bed of the patient. This operation is also reversed for the loading of a patient into the bed. The linkages and components of the invention cooperate and orient the spring panels and their respective sections into generally coplanar form when the mattress is flat and unfolded. Also, the moving components of the invention avoid intersecting with the frame during operations of the invention.

From the aforementioned description, a rotating and articulating sleeping assembly has been described. The rotating and articulating sleeping assembly is uniquely capable of rotating a seated patient on a bed to exit that bed from the side. The rotating and articulating sleeping assembly and its various components may be may be manufactured from many materials, including but not limited to, steel, aluminum, polymers, ferrous and non-ferrous metal foils, their alloys, and composites.

Various aspects of the illustrative embodiments have been described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations have been set forth in order to provide a thorough understanding of the illustrative embodiments. However, it will be apparent to one skilled in the art that the present invention may be practiced without the specific details. In other instances, well known features are omitted or simplified in order not to obscure the illustrative embodiments.

Various operations have been described as multiple discrete operations, in a manner that is most helpful in understanding the present invention, however, the order of description should not be construed as to imply that these operations are necessarily order dependent. In particular, these operations need not be performed in the order of presentation.

Moreover, in the specification and the following claims, the terms "first," "second," "third" and the like—when they appear—are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to allow the reader to ascertain the nature of the technical disclosure. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

We claim:

1. An assembly to rotate a seated patient transverse upon a bed comprising:

a frame, said frame having two spaced apart ends and two spaced apart rails, said rails being perpendicular to said ends, each of said rails having a drop section generally centered thereon;

a base plate spanning between said rails upon said drop sections;

a turn table upon said base plate;

a pivot tray upon said turn table;

a plurality of linkages upon said pivot tray;

at least two sections operatively connected to said plurality of linkages;

at least two spring panels upon said at least to sections; and, a mattress, said mattress deflecting upon at least two folds;

wherein said assembly rotates through three hundred sixty degrees and said plurality of linkages, said at least two sections, said at least two spring panels, and said mattress cooperate for transverse unloading and loading of said assembly by a patient;

wherein said assembly is adapted to pivot proximate the center of mass of a patient and is adapted to bend the legs of a patient so the knees of the patient reach near ninety degrees and to then rotate the patient so the feet of the patient have an orientation towards a supporting surface.

2. The assembly to rotate a seated patient transverse upon a bed of claim 1 further comprising:

a foot section, a thigh section, and a back section forming a frame, said foot section, said thigh section, and said back section operatively engaging said plurality of linkages.

3. The assembly to rotate a seated patient transverse upon a bed of claim 1 further comprising:

said base plate having at least two apertures, said at least two apertures having an orientation wherein said assembly provides at least two position of rotation relative to the bed; and, a rotational lock pin cooperating with said pivot tray and said at least two apertures wherein said rotation lock pin occupies one of said apertures.

4. An assembly to rotate a seated patient transverse upon a bed comprising:

a frame, said frame having two spaced apart ends and two spaced apart rails, said rails being perpendicular to said ends, each of said rails having a drop section generally centered thereon;

a base plate spanning between said rails upon said drop sections;

a turntable upon said base plate, said base plate having at least two apertures, said at least two apertures having an orientation wherein said assembly provides at least two positions of rotation relative to the bed, and a rotational lock pin cooperating with said pivot tray and said at least two apertures wherein said rotational lock pin occupies one of said apertures;

a pivot tray upon said turn table;

a plurality of linkages upon said pivot tray;

a foot section, a thigh section, and a back section forming a bed frame, said foot section, said thigh section, and said back section operatively engaging said plurality of linkages;

at least two spring panels upon said at least to sections; and, a mattress, said mattress deflecting upon at least two folds;

wherein said assembly rotates through three hundred sixty degrees and said plurality of linkages, said at least two sections, said at least two spring panels, and said mattress cooperate for transverse unloading and loading of said assembly by a patient;

wherein said assembly is adapted to pivot proximate the center of mass of a patient and is adapted to bend the legs of a patient so the knees of the patient reach near ninety degrees and to then rotate the patient so the feet of the patient have an orientation towards a supporting surface.

5. The assembly to rotate a seated patient transverse upon a bed of claim 4 further comprising:

said plurality of linkages cooperating and orienting said at least two spring panels and their respective sections in a generally coplanar form when said mattress is flat and without a fold therein.

6. The assembly to rotate a seated patient transverse upon a bed of claim 4 further comprising:

said pivot tray and said turntable having a position below said frame rails; and, wherein said plurality of linkages, said pivot tray, said foot section, said thigh section, and said back section, said at least two spring panels, and said mattress avoid intersecting with said frame during operations of said assembly.

7. An assembly to load and then to unload a seated patient transverse upon a bed, comprising:

two parallel drop sections and two parallel cross members forming a frame;

said frame connecting to a headboard and a footboard;

a base plate connecting to said frame and spanning across said drop sections;

a turntable joining to said base plate;

a pivot tray connecting to said turntable and a bed frame operatively connecting to said turntable;

a plurality of linkages upon said pivot tray;

said bed frame having three sections adapted to correspond to the calves, thighs, and torso of a patient respectively, said sections including folding mechanisms, electrical actuators, and a common controller for said electrical actuators;

planar sets of springs placed upon each of said sections of said bed frame and a mattress placed upon said planar sets of springs; and, a crank mechanism operatively connecting to said turntable wherein said assembly operates in the absence of electrical power to said actuators;

wherein said assembly rotates through three hundred sixty degrees and said plurality of linkages, said two drop sections, said planar set of springs, and said mattress cooperate for transverse unloading and loading of said assembly by a patient;

wherein said assembly is adapted to pivot proximate the center of mass of a patient and is adapted to bend the legs of a patient so the knees of the patient reach near ninety degrees and to then rotate the patient so the feet of the patient have an orientation towards a supporting surface.

* * * * *